United States Patent [19]

Dinerstein et al.

[11] Patent Number: 4,577,648

[45] Date of Patent: Mar. 25, 1986

[54] FINGERNAIL SHIELDING DEVICE

[76] Inventors: Frances Dinerstein, 100 W. 57th St., New York, N.Y. 10019; Lia Dinerstein, 30 E. 9th St., New York, N.Y. 10003

[21] Appl. No.: 105,256

[22] Filed: Dec. 19, 1979

[51] Int. Cl.[4] ..... A45D 29/00

[52] U.S. Cl. ..... 132/73

[58] Field of Search ..... 132/73, 88.5, 88.7

[56] References Cited

U.S. PATENT DOCUMENTS

| | | | |
|---|---|---|---|
| 1,512,364 | 10/1924 | Rose | 132/88.5 |
| 2,031,225 | 2/1936 | O'Donnell | 132/73 X |
| 3,245,418 | 4/1966 | Dinerstein | 132/88.5 |
| 3,382,878 | 5/1968 | Dinerstein | 132/88.5 |

*Primary Examiner*—Gregory E. McNeill

*Attorney, Agent, or Firm*—Hammond & Littell, Weissenberger & Dippert

[57] ABSTRACT

This invention is directed to a nail shielding device for use in applying a formaldehyde-containing liquid nail-hardening composition to human nails while protecting the cuticle and surrounding soft skin tissue from contact with said liquid compositions. The shielding device consists of an integral device having a forward end which is placed under the white tip of the nail, side and bottom portions which cover skin adjacent to the side edges of the nail and the bottom portion of the finger, a rear portion to cover the cuticle and skin to the rear of the cuticle, and two transverse apertures between the forward and rearward edges.

4 Claims, 3 Drawing Figures

FINGERNAIL SHIELDING DEVICE

FIELD OF THE INVENTION

This invention relates to a fingernail shielding device. More particularly, this invention relates to a device adapted for use in the application of liquid nail-hardening compositions to human fingernails.

BACKGROUND OF THE INVENTION

Liquid nail-hardening compositions are commonly used to harden the forward portion of fingernails, these portions usually referred to as the "white tips". Some of such liquid compositions contain a significant amount of formaldehyde and are applied by means of a small brush or the like. In some people the cuticle and soft tissue surrounding the fingernails are very sensitive to irritation by formaldehyde, and such persons must take meticulous care not to contact the cuticle and soft tissue with the formaldehyde-containing nail-hardening composition.

To prevent any possibility of irritation of the cuticle and soft tissue, the Food and Drug Administration requires formaldehyde-containing nail-hardening compositions to be sold together with a suitable stencil or shield which prevents the liquid nail-hardening composition from coming into contact with the cuticle and soft tissue. U.S. Pat. Nos. 3,245,418 and 3,382,878 disclose shielding devices for applying nail-hardening compositions to fingernails. Each device employs an adhesive to attach the device to a fingernail during application of nail-hardening composition. However, such adhesive-containing devices have certain disadvantages, such as being cumbersome and awkward to handle.

OBJECTS OF THE INVENTION

It is an object of this invention to provide a novel fingernail shield.

It is also an object of this invention to provide a fingernail shield for protecting cuticle and soft tissue from contact with a nail-hardening composition.

It is a further object of the present invention to provide a shield which exposes the white tip of the nail for coating with a formaldehyde-containing, liquid nail-hardening composition while protecting the cuticle and surrounding skin against contact with the liquid composition.

It is yet another object of the invention to provide a novel nail shield which enables one to rapidly coat fingernails with liquids comprising formaldehyde without contacting the cuticle and surrounding skin with the liquids.

These and other objects of the invention will become more apparent in the discussion below.

DESCRIPTION OF THE INVENTION

Applicants have discovered a novel non-adhesive containing fingernail shielding device. The novel nail shield or stencil of the present invention for applying formaldehyde-containing liquids to human nails while protecting the cuticle and surrounding skin from the liquid comprises an integral device having a projecting forward end which is placed under the white tip of the nail, side and bottom portions which cover the skin adjacent to the side edges of the nail as well as the bottom portion of the finger, a rear portion to cover the cuticle and the skin to the rear of the cuticle, and two transverse apertures approximately one-third and midway, respectively, between the forward and the rearward edges of the stencil.

Figure 1:
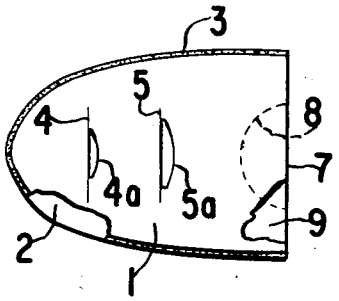
FIG. 1 is a plan view of the shielding device of the present invention.

In the embodiment of the invention illustrated in FIG. 1, the shielding device of the invention consists of a top section 1 and bottom section 2, which are joined in the front and on the sides by seam 3. Top section 1 contains two substantially linear slits 4 and 5, which have rearwardly curved edges 4*a* and 5*a*, respectively. Linear slits 4 and 5 are located approximately one-third and one-half, respectively, of the distance from front edge 6 to rear edge 7. Bottom section 2 preferably has a notch 8, or similar configuration, to aid in the application of the shielding device, whereby the desired finger is inserted into opening 9.

Figure 2:
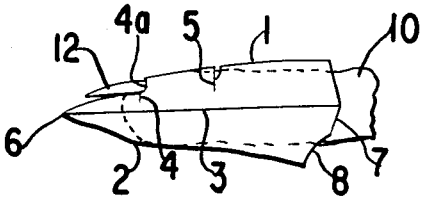
FIG. 2 illustrates a small finger with the shielding device of the invention placed in position about a fingernail.
Figure 3:
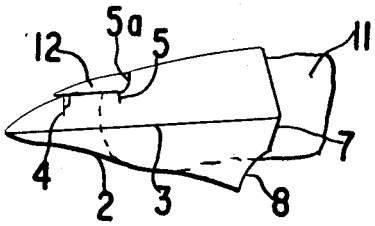
FIG. 3 illustrates a large finger or thumb with the shielding device placed in position about the fingernail.

FIGS. 2 and 3 illustrate the shielding device as applied to a small finger 10 and large finger or thumb 11, respectively. The shielding device is applied by inserting the desired finger into the opening 9 and slipping the white tip 12 of the fingernail through linear slit 4 or 5 so that the forward portion of the shielding device is beneath the white tip 12. When the shielding devices are so positioned on the small finger 10 or large finger or thumb 11 as shown in FIGS. 2 and 3, respectively, the white tips 12 of the fingernails can be treated with liquids as desired without contacting the cuticles and the surrounding soft tissues.

The shielding device can be manufactured from any suitable, pliable material. Suitable materials would include primarily paper, celluloid, and polymeric or plastic materials. Preferably a clear or brightly colored polymeric material is used.

The shielding device can be any suitable size. Preferably, the device, when flat, measures from about 1.5 to 2.0 inches, most preferably about 1.9 inches, from the front edge to the back edge and from about 1.0 to 1.5 inches, most preferably about 1.3 inches, from one side to the other. The linear slits are each from about 0.4 to 0.7 inches in length.

When properly applied, the shielding device of this invention will snugly fit the finger to be treated. The device can be easily removed by merely grasping front edge 6 or the sides of the device and gently pulling in the direction of front edge 6.

Various modifications of the shielding device of the invention may be made without departing from the spirit or scope thereof, and it is to be understood that the invention is to be limited only as defined in the appended claims.

We claim:

1. A non-adhesive containing nail shielding device for use in applying a formaldehyde-containing liquid nail-hardening composition to human nails while protecting the cuticle and surrounding soft skin tissue from contact with said liquid composition, said shielding device consisting of an integral device having (i) a top surface comprising a forward end which is placed under the white tip of the nail, side portions which cover skin adjacent to side edges of the nail, a rear portion to cover the cuticle and skin to the rear of the cuticle, and two transverse apertures between the forward and rearward edges, the transverse aperture closer to the forward edge being smaller than the other transverse aperture, and (ii) a bottom surface which covers the bottom portion of the finger, the bottom surface and the top surface being joined on their forward and lateral edges and having a rearward opening into which the finger is inserted.

2. The nail shielding device of claim 1 wherein the transverse apertures are located approximately one-third and midway, respectively, of the distance from the front edge to the rear edge of the top surface.

3. The nail shielding device of claim 1 wherein the transverse apertures comprise substantially linear slits having rearwardly curved edges.

4. The nail shielding device of claim 1 wherein the bottom surface has a notch on its rearward edge.

* * * * *